US005994886A

United States Patent [19]

Shinozaki

[11] Patent Number: 5,994,886

[45] **Date of Patent: *Nov. 30, 1999**

[54] INTERNAL STEP-DOWN POWER SUPPLY CIRCUIT OF SEMICONDUCTOR DEVICE

[75] Inventor: Naoharu Shinozaki, Kawasaki, Japan

[73] Assignee: Fujitsu Limited, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/926,463

[22] Filed: Sep. 10, 1997

[30] Foreign Application Priority Data

Apr. 11, 1997 [JP] Japan ..... 9-093874

[51] Int. Cl.[6] ..... G05F 5/08

[52] U.S. Cl. ..... 323/303

[58] Field of Search ..... 323/303; 363/21; 365/226; 327/545

[56] References Cited

U.S. PATENT DOCUMENTS

| | | | |
|---|---|---|---|
| 5,337,282 | 8/1994 | Koike | 365/228 |
| 5,428,299 | 6/1995 | Koshikawa | 324/763 |
| 5,463,585 | 10/1995 | Sanada | 365/226 |
| 5,557,232 | 9/1996 | Shimogawa | 327/545 |
| 5,675,280 | 10/1997 | Nomura et al. | 327/545 |

*Primary Examiner*—Adolf Deneke Berhane
*Attorney, Agent, or Firm*—Nikaido, Marmelstein, Murray & Oram LLP

[57] ABSTRACT

An internal step-down power supply circuit for lowering an external power supply voltage supplied from outside to an internal power supply voltage in a semiconductor device includes a circuit for generating the internal power supply voltage in response to a control voltage, potential regulation circuits for a normal operation and for a test operation, respectively, having fuse elements for making it possible to regulate the potential of the control circuit, and potential control circuits disposed for the normal operation and for the test operation, respectively, for controlling the potential of the control voltage on the basis of the output of the corresponding potential regulation circuit. The external power supply voltage is used as a power supply of the potential regulation circuit for the normal operation and the internal power supply voltage is used as a power supply of the potential regulation circuit for the test operation. This circuit construction can reduce a DC path current in a fuse circuit for regulating the potential of the internal step-down voltage power supply voltage and can provide low power consumption and stable operations.

17 Claims, 8 Drawing Sheets

INTERNAL STEP-DOWN POWER SUPPLY CIRCUIT OF SEMICONDUCTOR DEVICE

BACKGROUND OF THE INVENTION

1. Field of the Invention

This invention relates to an internal step-down power supply circuit of a semiconductor device. More particularly, it relates to the construction of a power supply circuit using a fuse circuit for regulating a potential of an internal step-down voltage power supply voltage.

A requirement for lower power consumption has become stronger and stronger in semiconductor devices, and a circuit technology for bringing a DC path current occurring in a fuse circuit to as close to zero as possible has become necessary. Nonetheless, existing power supply circuits cannot entirely satisfy such a requirement, and improvements must be yet made. Therefore, a circuit technology for satisfying the requirement is necessary.

2. Description of the Related Art

It is generally a common practice in semiconductor devices to lower an external power supply voltage to a power source voltage required inside a chip and to use the voltage (so-called "internal step-down voltage") so as to reduce power consumption, to improve a withstand voltage of an oxide film, to keep a power supply voltage constant, and so forth.

FIG. 1 shows an example of characteristics of an internal step-down power supply voltage (VII) relative to an external power supply voltage (VCC). The example shown in the drawing represents the case where a product using VCC=3.3 V as the external power supply voltage is used.

A recommended operation range of products using VCC 3.3 V is generally from 3.0 to 3.6 V according to their specifications. However, an internal step-down voltage power supply circuit, which is controlled so as to become flat (or constant) at VII=2.4 V is used in practice inside the chip in order to accomplish the objects described above.

On the other hand, the occurrence of detective products is unavoidable in semiconductor devices. The forms of such product defects are dominantly the type in which defects appear immediately after the production and the type in which the defects appear in the course of time due to life of the products, as is well known from a so-called "bathtub curve". The former is referred to as "initial defect".

Accelerated tests such as a burn-in (B.I.) test have been conducted in the semiconductor devices to eliminate the initial defect at an early stage. This test is carried out by imposing a severe condition (for example, a condition under which the devices-are operated for a long time at a voltage higher than the recommended operation range and at a high temperature) on the devices.

In the example shown in FIG. 1, a range of VCC≧4 V is set to the accelerated test range. Inside this range, the internal step-down power supply voltage (VII) is released from the flat state of VII=2.4 V and is controlled in such a manner as to follow the external power supply voltage (VCC) and to attain a high potential.

For the reasons described above, the heretofore known internal step-down power supply circuits generally comprise a power supply voltage control portion for a normal operation and a power supply voltage control portion for a test operation. FIG. 2 shows one structural example.

In FIG. 2, reference numeral 50 denotes a VII potential regulation circuit for a normal operation. This circuit 50 includes a fuse circuit 51 using fuse elements for making it possible to regulate a potential of an internal step-down voltage VII in accordance with a potential of a node N after completion of the process, and a decoder circuit 52 for decoding information representing a cut-off state of the fuse elements in the fuse circuit 51. Reference numeral 53 denotes a VII potential control circuit for a normal operation which controls the potential of the node N on the basis of the decoding result of the decoder circuit 52, reference numeral 54 denotes a VII generation circuit for a normal operation which generates an internal step-down power supply voltage in response to the output (potential of the node N) of the VII potential control circuit 53 for the normal operation.

Similarly, reference numeral 55 denotes a VII potential regulation circuit for a test operation. This circuit 55 includes a fuse circuit 56 using fuse elements for making it possible to regulate the potential of the internal step-down power supply voltage VII in accordance with the potential of the node N after process-out, and a decoder circuit 57 for decoding information representing the cut-off state of the fuse elements in the fuse circuit 56. Reference numeral 58 denotes a VII potential control circuit for the test operation for controlling the potential of the node N on the basis of the decoding result of the decoder circuit 57. The output of this VII potential control circuit 58 for the test operation is connected to the node N. Therefore, the VII generation circuit 54 generates the internal step-down power supply voltage VII in response to the output (potential of the node N) of the VII potential control circuit 58 in the test operation.

External power source voltages (VCC) are used as circuit power supplies of the VII potential regulation circuit 50 and the VII potential control circuit 53 for the normal operation, of the VII potential regulation circuit 55 and the VII potential control circuit for the test operation, and of the VII generation circuit 54, respectively.

In the circuit construction described above, the potential at the node N is decided by the output of each of the VII potential control circuits 53 and 58 for the normal and test operations. When products are manufactured under undesirable conditions such as a process fluctuation, however, the voltage for controlling the VII potential (potential at the node N) at a target cannot be outputted in most cases.

Therefore, in order to make it possible to regulate this voltage for controlling the VII potential (potential of the node N) after completion of the process, the VII potential regulation circuit 50 for the normal operation and the VII potential regulation circuit 55 for the normal operation are provided.

In other words, each fuse element in the fuse circuit 51 inside the VII potential regulation circuit 50 is kept appropriately in the cut-off state in the normal operation, information representing the cut-off state of this fuse element is decoded by the decoder circuit 52, and the potential of the node N is regulated by the VII potential control circuit 53 on the basis of this decoding result.

Similarly, several fuse elements in the fuse circuit 56 inside the VII potential regulation circuit 55 are kept under the cut-off state in the test operation, information representing the cut-off state of these fuse elements is decoded by the decoder circuit 57, and the potential of the node N can thus be regulated by the VII potential control circuit 58 on the basis of this decoding result.

As described above, the prior art technology uses the fuse circuits 51 and 56 for making it possible to regulate the potential of the node N (that is, the potential of the internal step-down power supply voltage VII) after completion of the process. Therefore, a DC path current occurs through the fuse elements in each fuse circuit. As attempts have been made to further decrease power consumption at present, the value of this DC path current becomes a value that can never be neglected in comparison with the current value allowed by product specifications.

Further, the prior art technology uses the external power supply voltages (VCC) for all the circuits that constitute the internal step-down power supply circuit and for this reason, the problem described above appears all the more remarkable in some cases. In other words, if the cut-off state of each fuse element in the fuse circuit is not complete (or if the resistance value is not very high) in-this circuit construction, the DC path current increases proportionally, As a result, the greater the number of the fuse elements, the more remarkable becomes this problem. A consumed current value of $\mu$A order exists in the latest device catalogues, and lower power consumption must be by all means accomplished. Since the DC path current in this fuse circuit is likely to govern the specification value of a $\mu$A order, the current value must be reduced to a minimum.

When the DC path current increases, the voltage appearing across both ends of each fuse element (that is, information representing the cut-off state of the fuse element) is likely to become unstable, so that operational reliability of the fuse circuit itself might fall. This makes the operation of the internal step-down power supply circuit unstable as a whole.

SUMMARY OF THE INVENTION

It is therefore an object of the present invention to provide an internal step-down power supply circuit which can reduce a DC path current in a fuse circuit for regulating a potential of an internal step-down power supply voltage in a semiconductor device using a step-down voltage by lowering an external power supply voltage to a power supply voltage needed internally, and can eventually reduce power consumption and accomplish a stable operation.

According to the present invention, there is provided an internal step-down power supply circuit of a semiconductor device for lowering an external power supply voltage supplied from outside to an internal power supply voltage in a semiconductor device, comprising: a circuit for generating the internal power supply voltage in response to a control voltage; potential regulation circuits disposed for a normal operation and for a test operation, respectively, and having fuse elements for making it possible to regulate the potential of the control voltage; and potential control circuits disposed for the normal operation and for the test operation, respectively, and controlling the potential of the control voltage on the basis of the output of the potential regulation circuit corresponding thereto, respectively; wherein the external power supply voltage is used as a power supply for the potential regulation circuit for the normal operation, and the internal power supply voltage is used as a power supply for the potential regulation circuit for the test operation.

The circuit construction of the present invention uses the voltage (internal step-down power supply voltage) having a potential lower than the normal power supply voltage (external power supply voltage) as the power supply voltage for the circuit portion (potential regulation circuit) which is required to operate in the test operation such as the burn-in test. Therefore, the DC path current flowing through the fuse elements inside the potential regulation circuit can be reduced relatively, and this reduction contributes to lower power consumption.

Because the DC path current is relatively reduced, the voltage appearing across both ends of the fuse element (that is, information representing the cut-off state of the fuse element) can be relatively stabilized. As a result, the stable operation of the overall internal step-down power supply circuit can be accomplished.

BRIEF DESCRIPTION OF THE DRAWINGS

Other objects and features of the present invention will be described hereinafter in detail by way of preferred embodiments with reference to the accompanying drawings, in which.

DESCRIPTION OF THE PREFERRED EMBODIMENTS

Figure 3:
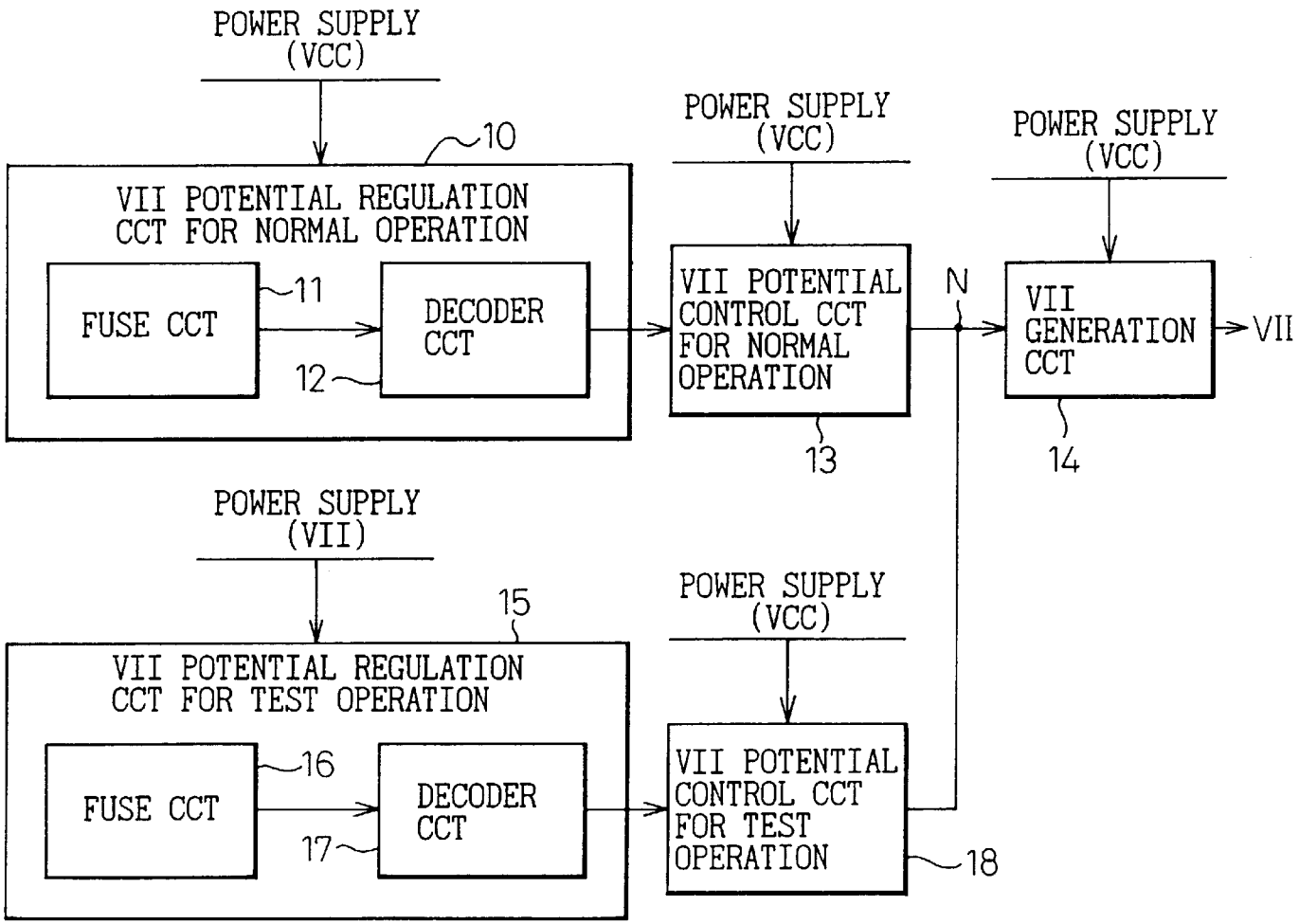
FIG. 3 is a block diagram showing the construction of an internal step-down power supply circuit of a semiconductor device according to the first embodiment of the present invention.

FIG. 3 shows the construction of an internal step-down power supply circuit of a semiconductor device according to the first embodiment of the present invention.

Figure 1:
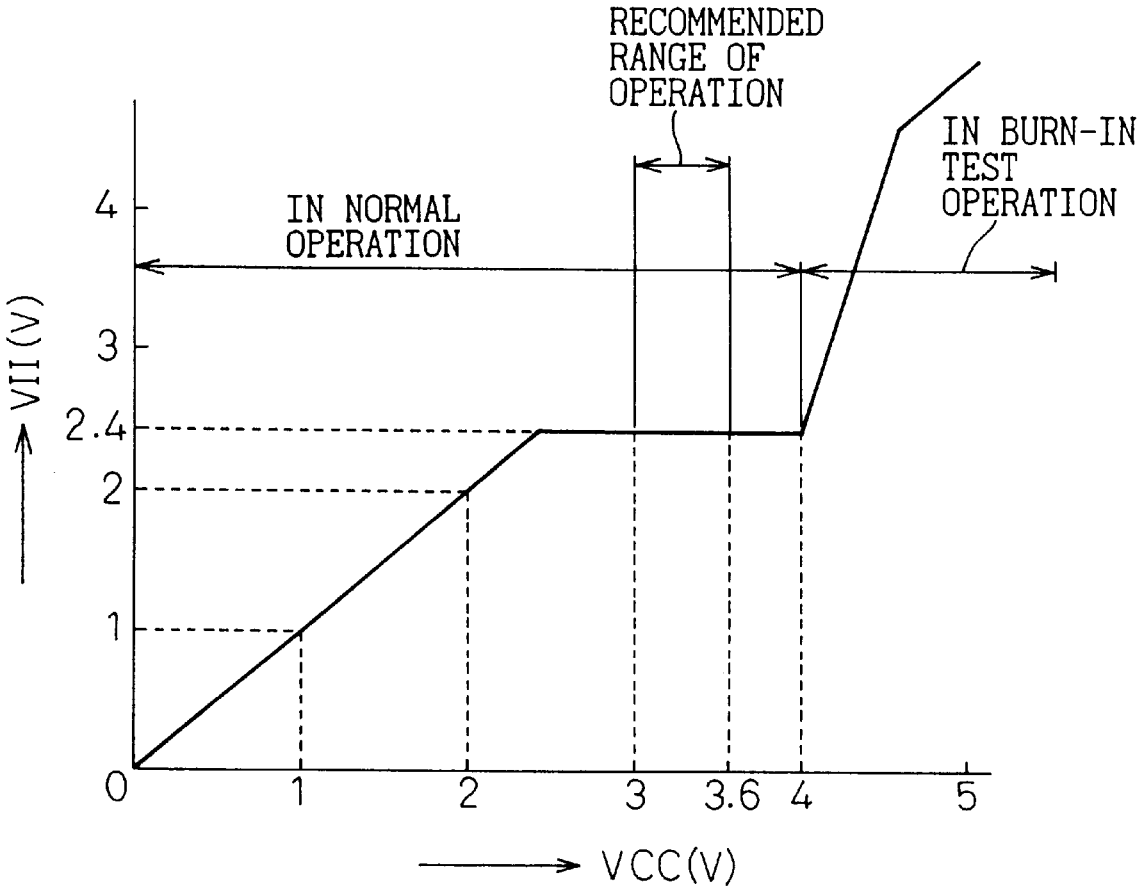
FIG. 1 is a diagram showing an example of a characteristic of an internal step-down power supply voltage (VII) with respect to an external power supply voltage (VCC)
Figure 2:
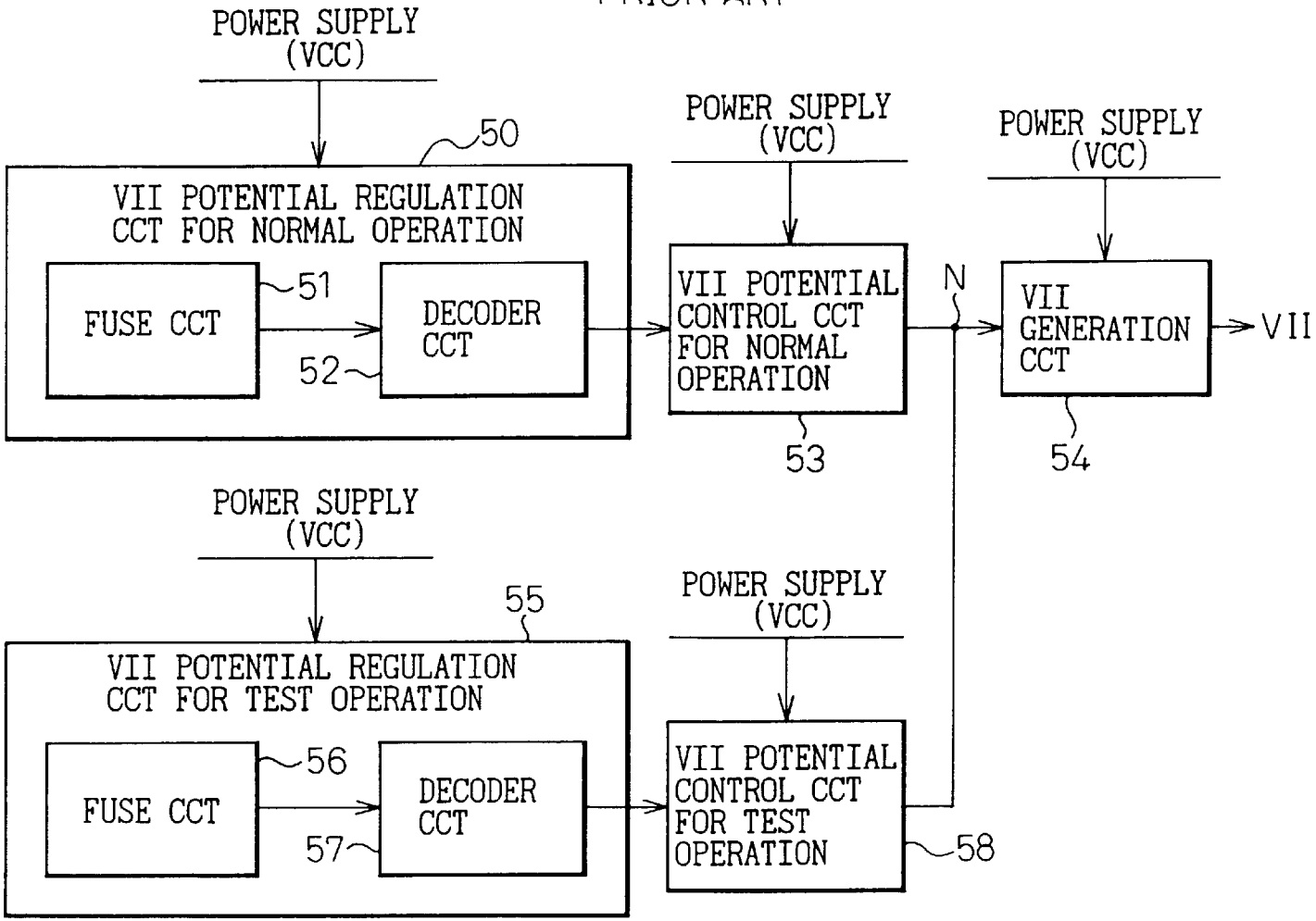
Fig. 2 PRIOR ART
FIG. 2 is a block diagram showing the construction of an internal step-down power supply circuit of a semiconductor device according to the prior art.

Structurally, the internal step-down power supply according to this embodiment is almost the same as the construction of the prior art circuit shown in FIG. 2. In other words, the constituent elements represented by reference numerals 10 to 18 in this embodiment correspond to the constituent elements 50 to 58 in FIG. 2, and since the operation of each of these elements is the same, the explanation will be hereby omitted.

The characterizing feature of the internal step-down power supply circuit according to this embodiment resides in that an internal step-down power supply voltage VII having a lower potential than an external power supply voltage VCC is used as a circuit power supply for only a VII potential regulation circuit 15 (including a fuse circuit 16 and a decoder circuit 17) for which an operation is required at the time of a test operation such as a burn-in test, and the external power supply voltages VCC are used as a circuit power supply for all the other circuits.

Figure 4:
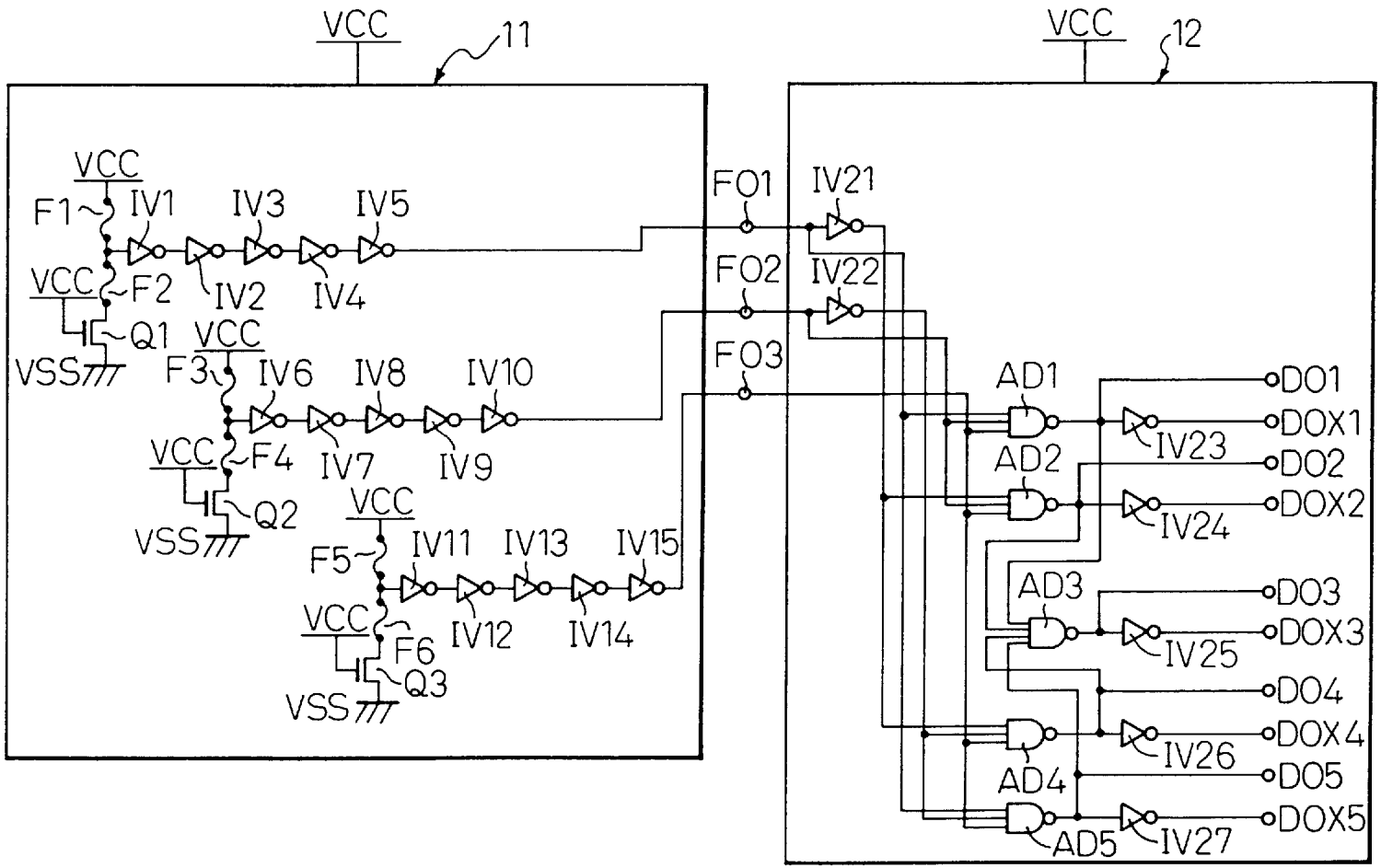
FIG. 4 is a circuit diagram showing an example of a VII potential regulation circuit for a normal operation in FIG. 3.
Figure 5:
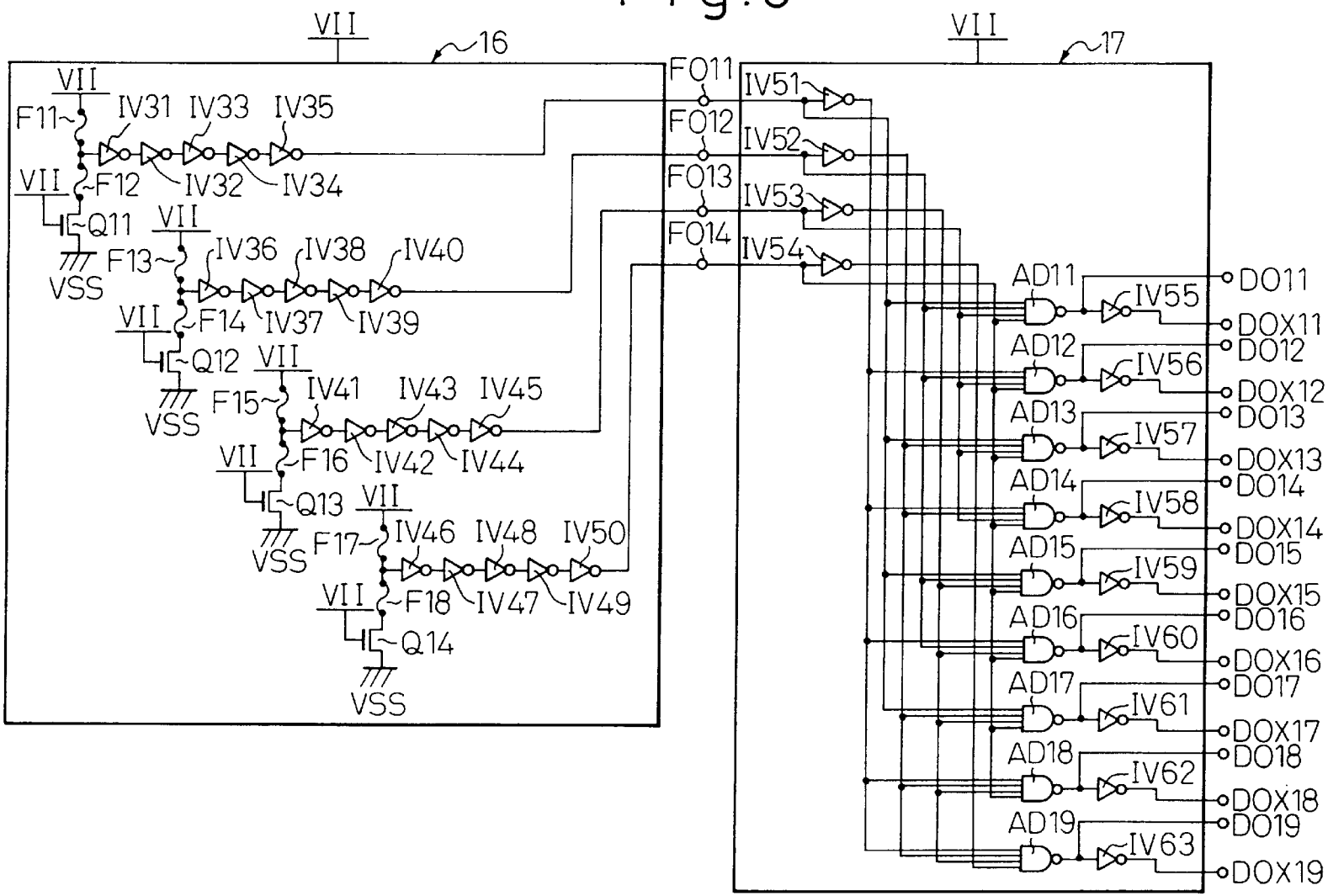
FIG. 5 is a circuit diagram showing an example of a VII potential regulation circuit for a test operation in FIG. 3.
Figure 6:
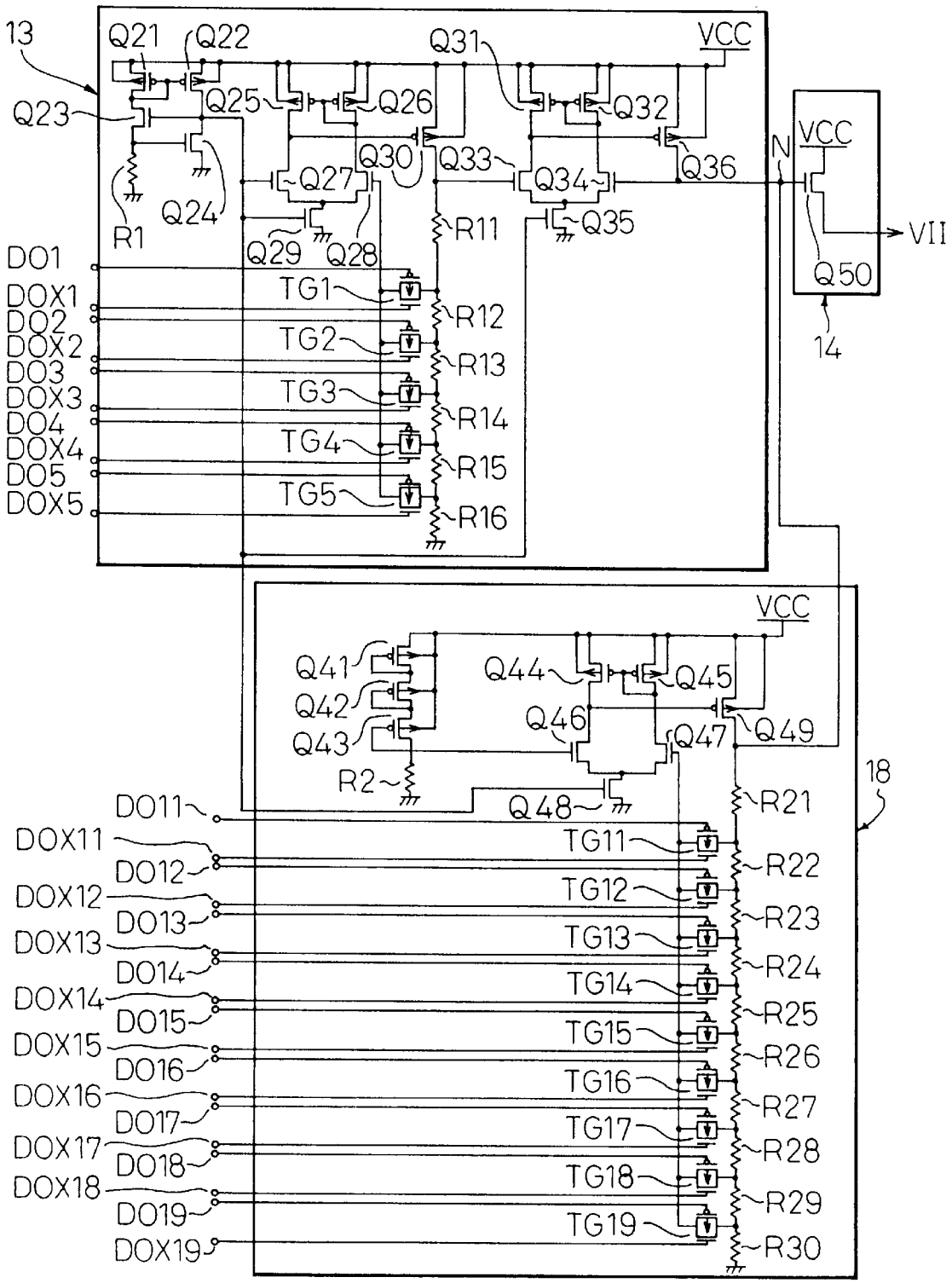
FIG. 6 is a circuit diagram showing an example of a VII potential control circuit and a VII generation circuit in FIG. 3.

FIGS. 4 to 6 show a concrete structural example of each circuit constituting the internal step-down power supply according to this embodiment.

FIG. 4 shows a structural example of the VII potential regulation circuit 10 (including the fuse circuit 11 and the decoder circuit 12) for the normal operation. As shown in the drawing, the fuse circuit 11 comprises fuse elements F1 to F6. In channel transistors Q1 to Q3 and inverters IV1 to IV15, and the decoder circuit 12 comprises inverters IV21 to IV27 and AND gates AD1 to AD5. Symbols FO1 to FO3 denote the information indicating the cut-off state of the fuse elements, and DO1, DOX1 to DO5 and DOX represent decode information, respectively.

FIG. 5 shows a structural example of the VII potential regulation circuit 15 (including the fuse circuit 16 and the decoder circuit 17) for the test operation. As shown in the drawing, the fuse circuit 16 comprises the fuse elements F11 to F18, n channel transistors Q11 to Q14 and inverters IV31 to IV50, and the decoder circuit 17 comprises inverters IV51 to IV63 and AND gates AD11 to AD19. Symbols DO11, DOX11 to DO19 and DOX19 denote decode information, respectively.

FIG. 6 shows a structural example of the VII potential control circuits 13 and 18 for the normal operation and for the test operation and a structural example of the VII generation circuit 14. As shown in the drawing, the VII potential control circuit 13 for the normal operation comprises a first current mirror circuit (p channel transistors Q21 and Q22, n channel transistors Q23 and Q24 and a resistor R1), a second current mirror circuit (p channel transistors Q25 and Q26 and n channel transistors Q27 to Q29), a p channel transistor Q30, a third current mirror circuit (p channel transistors Q31 and Q32 and n channel transistors Q33 to Q35), a p channel transistor Q36, transfer gates TG1 to TG5 responding to the decode information DO1, DOX1 to DOS and DOX5, and a resistor string (resistors R11 to R16) the resistance value of which changes depending on the states of the transfer gates. The VII potential control circuit 18 for the test operation comprises p channel transistors Q41 to Q43 and a resistor R2 constituting a level shifter, a current mirror circuit (p channel transistors Q44 and Q45 and n channel transistors Q46 to Q48), a p channel transistor Q49, transfer gates TG11 to TG19 responding to the decode information DO11, DOX11 to DO19 and DOX19 and a resistor string (resistors R21 to R30) the resistance value of which varies depending on the states of the transfer gates. The VII generation circuit 14 comprises an n channel transistor Q50 responding to the potentials of the output terminal (node N) of each of the VII potential control circuits 13 and 18. In other words, in the example shown in in the drawing, voltage conversion from the external power supply voltage VCC to the internal step-down power supply voltage VII is carried out in accordance with the potential of the gate of the transistor 50 (the potential of the node N).

According to the circuit construction described above, the information representing the cut-off state of each fuse element F1 to F6 (fuse information FO1 to FO3) is outputted from the fuse circuit 11 (refer to FIG. 4) in the normal operation, and is supplied to the corresponding decoder circuit 12 (refer to FIG. 4). The decoder circuit 12 decodes the fuse information FO1 to FO3 so inputted, and outputs the decoding result as the decode information DO1, DOX1 to DO5 and OX5. The decode information DO1, DOX1 to DO5 and DOX5 outputted in this way are supplied to the corresponding VII potential regulation circuit 13 (refer to FIG. 6). The VII potential control circuit 13 turns ON or OFF each transfer gate TG1 to TG5 on the basis of the inputted decode information DO1, DOX1 to DO5 and DOX, so that the resistance value of the resistance string (resistors R11 to R16) is decided. The potential of the node N, that is, the potential of the internal step-down power supply voltage VII, is decided in accordance with the resistance value decided in this way.

Similarly, the information (fuse information FO11 to FO14) representing the cut-off state of each fuse element F11 to F18 is outputted from the fuse circuit 16 (refer to FIG. 5) during the test operation and is supplied to the corresponding decoder circuit 17 (refer to FIG. 5). The decode circuit 17 decodes the inputted fuse information FO11 to FO14 and outputs the decoding result as the decode information DO11, DOX11 to DO19 and DOX19. The outputted decode information DO11, DOX11 to DO19, DOX19 is supplied to the corresponding VII potential control circuit 18 (refer to FIG. 6). The VII potential control circuit 18 turns ON and OFF each transfer gate TG11 to TG19 on the basis of the decode information DO11, DOX11 to DO19, DOX19 so inputted, so that the resistance value of the resistor string (resistors R21 to R30) is decided. The potential at the node N, that is, the potential of the internal step-down power supply voltage VII, is decided on the basis of the resistance value so decided.

According to the construction of the first embodiment explained above, the internal step-down power supply voltage VII lower than the normal power source voltage (VCC) is used for the power source of the VII potential regulation circuit 15 (the fuse circuit 16 and the decode circuit 17) for the test operation. Therefore, the DC path current flowing through each fuse element F11 to F18 in the fuse circuit 16 can be relatively reduced.

The effect of the reduction of the DC path current in the overall circuit can be quantitatively expressed by the following formula:

$$ICC=I\times\{(nn\times VCC)+(nb\times VII)\}/(nn+nb)\times VCC$$

Here, ICC represents the DC path current after the measure is taken (this embodiment), I represents the DC path current before the measure is taken (the prior art technology shown in FIG. 2, for example), nn represents the number of paths of the fuse elements in the fuse circuit 11 for the normal operation, and nb represents the number of paths of the fuse elements in the fuse circuit 16 for the test operations In the structural examples shown in FIGS. 4 and 5, nn=3 and nb=4. Assuming that VCC=3.3 V and VII=2.4 V, $$ICC = I\times\{(3\times 3.3)+(4\times 2.4)\}/(3+4)\times 3.3$$

$$= 0.84I$$

In other words, the current can be reduced by about 16%.

Because the construction of this embodiment can reduce the DC path current occurring in the fuse circuit, the embodiment can sufficiently satisfy a requirement for lower power consumption.

Because the DC path current is reduced, further, the voltage appearing across both ends of each fuse element in the fuse circuit (that is, the information representing the cut-off state of each fuse element) can be stably supplied to the decoder circuit of the next stage. Accordingly, the operation of the internal step-down power supply circuit inclusive of the fuse circuit and the decoder circuit can be stably maintained as a whole.

Figure 7:
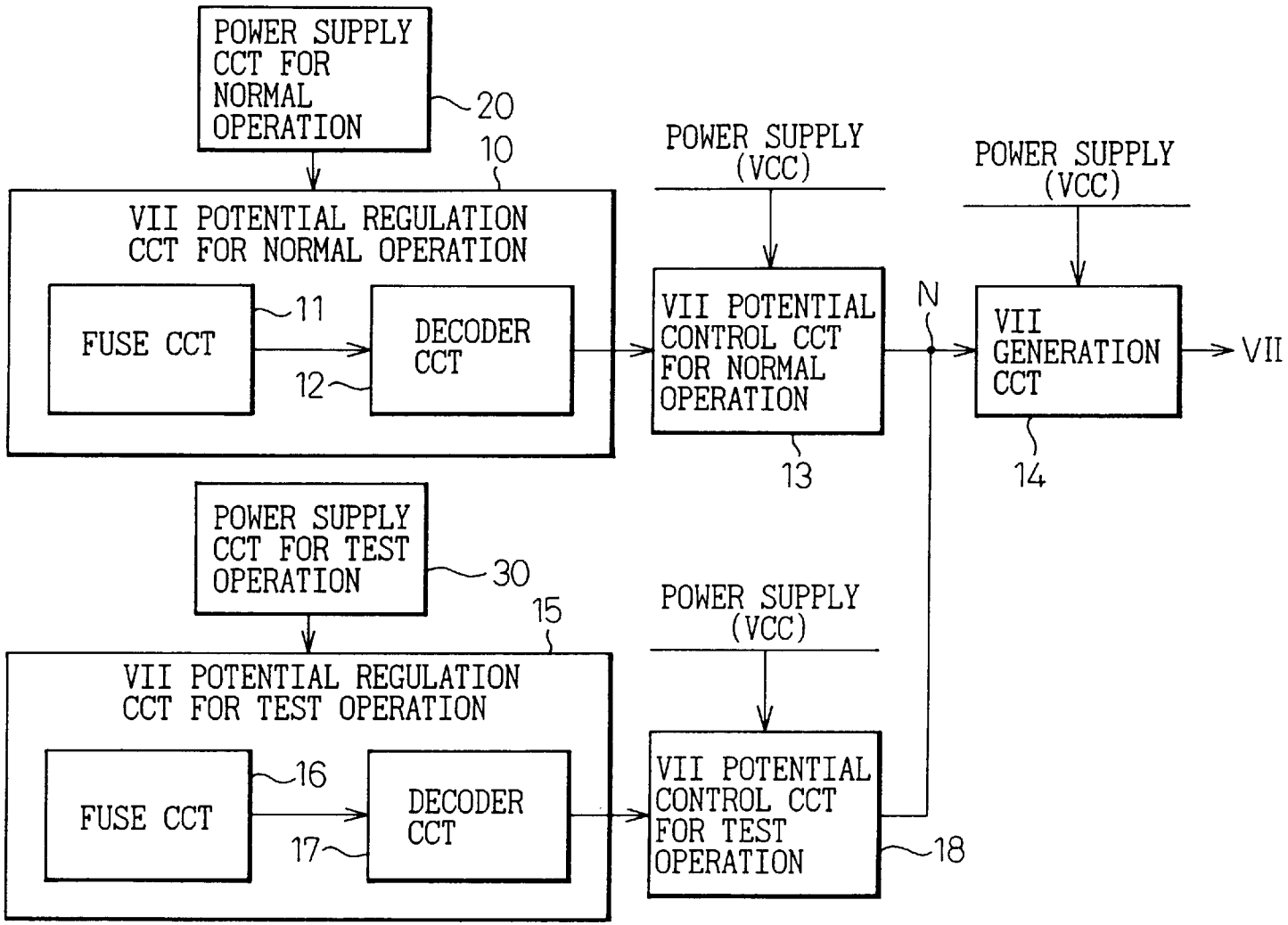
FIG. 7 is a block diagram showing the construction of an internal step-down power supply circuit of a semiconductor device according to the second embodiment of the present invention.

FIG. 7 shows exemplarily the construction of an internal step-down power supply circuit of a semiconductor device according to the second embodiment of the present invention.

The internal step-down power supply circuit according to this embodiment has substantially the same circuit construction as that of the first embodiment described above. The internal step-down power supply circuit of this second embodiment is characterized in that dedicated power supply circuits 20 and 30 are disposed as the power supplies for the VII potential regulation circuits 10 and 15 for the normal operation and for the test operation, respectively.

Figure 8A:
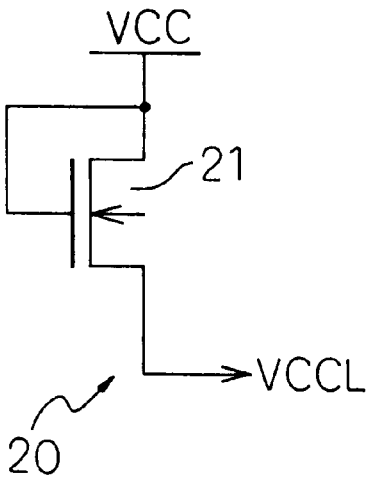
FIGS. 8*a* and 8*b* are circuit diagrams showing an example of a power supply circuit for a normal operation and an example of a power supply circuit for a test operation in FIG. 7, respectively.
Figure 8B:
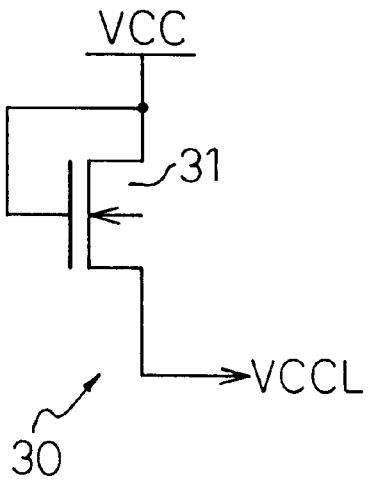

FIGS. 8*a* and 8*b* show a structural example of each of the power supply circuit 20 for the normal operation and the power supply circuit 30 for the test operation, respectively.

In the example shown in these drawings, the power supply circuit 20 for the normal operation comprises an n channel transistor 21 the drain of which is connected to the line of the external power supply voltage VCC and the gate of which is connected to the drain (refer to FIG. 8*a*). The power supply voltage VCCL to be supplied to the VII potential regulation circuit 10 for the normal operation is taken out from the source of transistor 21. In other words, the voltage VCCL having a lower potential than the external power supply voltage VCC is generated from the external power supply voltage VCC.

Similarly, the power supply circuit 30 for the test operation comprises an n channel transistor 31 the drain of which is connected to the line of the external power supply voltage VCC and the gate of which is connected to the drain (refer to FIG. 8*b*). The power supply voltage VCCL to be supplied to the VII potential regulation circuit 15 for the test operation is taken out from the source of this transistor 31. In other words, the voltage VCCL having a lower potential than the external power supply voltage VCC is generated from the external power supply voltage VCC.

The DC path current flowing through the fuse elements can be reduced by using the power supply circuits 20 and 30 having such a construction, and lower power consumption can be accomplished.

Figure 9A:
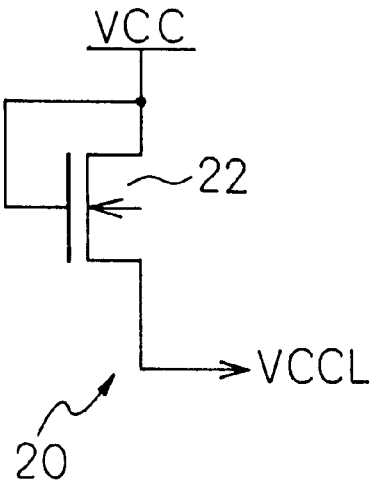
FIGS. 9*a* and 9*b* are circuit diagrams showing another example of the power supply circuits for the normal operation and the test operation in FIG. 7, respectively.
Figure 9B:
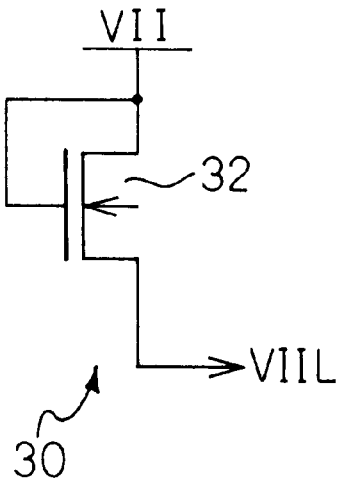

FIGS. 9*a* and 9*b* show another structural example of each of the power supply circuit 20 for the normal operation and the power supply circuit 30 for the test operation, respectively.

In the example shown in these drawings, the power supply circuit 20 for the normal operation comprises an n channel transistor 22 the drain of which is connected to the line of the external power supply voltage VCC and the gate of which is connected to the drain (refer to FIG. 9*a*). The power supply voltage VCCL to be supplied to the VII potential regulation circuit 10 for the normal operation is taken out from the source of the transistor 22. In other words, the voltage VCCL having a lower potential than the external power supply voltage VCC is generated from this external power supply voltage VCC.

On the other hand, the power supply circuit 30 for the test operation comprises an n channel transistor 32 the drain of which is connected to the line of the internal step-down power supply voltage VII and the gate of which is connected to its drain (refer to FIG. 9*b*). The power supply voltage VIIL to be supplied to the VII potential regulation circuit 15 for the test operation is taken out from the source of the transistor 32. In other words, the voltage VIIL having a lower potential than the internal step-down power supply voltage VII is generated from this internal step-down power supply voltage VII.

Power consumption can be lowered much more than in the structural example shown in FIGS. 8*a* and 8*b* by using the power supply circuits 20 and 30 having such a construction.

Incidentally, in the structural examples shown in FIGS. 8*a* to 9*b*, a voltage having a level lower by the threshold voltage of one n channel transistor than the level of the external power supply voltage VCC or the internal step-down power supply voltage VII is generated, but the construction of the power supply circuits 20 and 30 is not of course limited to the examples shown in these drawings.

What is claimed is:

1. An internal step-down power supply circuit receiving an external power supply voltage supplied from outside of a semiconductor device for generating an internal power supply voltage for use in the semiconductor device, said internal step-down power supply circuit comprising:

an internal power supply voltage generation circuit for generating said internal power supply voltage in response to a control voltage, said internal power supply voltage in a normal operation being lower than said external power supply voltage and the internal power supply voltage in a test operation being higher than the internal power supply voltage in the normal operation, a first potential adjustment circuit having fuse elements and generating a first adjustment signal for the normal operation;

a second potential adjustment circuit having fuse elements and generating a second adjustment signal for the test operation;

a first potential control circuit for controlling said control voltage on the basis of the first adjustment signal; and a second potential control circuit for controlling said control voltage on the basis of the second adjustment signal, wherein said internal power supply voltage is used as a power supply for said second potential adjustment circuit.

2. The internal step-down power supply circuit as set forth in claim 1, wherein each of said first and second potential control circuits includes a resistor string for determining said control voltage.

3. The internal step-down power supply circuit as set forth in claim 2, wherein each of said first and second potential adjustment circuits includes a fuse circuit containing corresponding fuse elements and a decoder circuit for decoding an output signal of the fuse circuit representing a state of said fuse elements in said fuse circuit to generate the corresponding one of said first and second adjustment signal, and terminal voltages of said resistor strings in the first and second potential control circuits are selected in accordance with the first and second adjustment signals, respectively.

4. An internal step-down power supply circuit for a semiconductor device for lowering a voltage of an external power supply supplied from outside of the semiconductor device, comprising:

a circuit receiving the external power supply for generating an internal power supply voltage in response to a control signal;

a potential adjustment circuit for a normal operation having fuse elements for outputting an adjustment signal;

a potential control circuit for the normal operation receiving the adjustment signal for controlling a potential of said control signal in response to the adjustment signal;

a power supply circuit generating a power supply voltage to the potential adjustment circuit, the power supply voltage having a lower potential than said voltage of the external power supply.

5. The internal step-down power supply circuit according to claim 4, wherein said potential control circuit for the normal operation has a resistor string for deciding the potential of said control signal.

6. The internal step-down power supply circuit as set forth in claim 5, wherein said potential adjustment circuit for the normal operation includes a fuse circuit containing the fuse elements and a decoder circuit for decoding an output signal of the fuse circuit representing a state of said fuse elements in said fuse circuit, and a resistance value of said resistor string is selected in accordance with a decoding result of said decoder circuit.

7. An internal step-down power supply circuit for a semiconductor device for lowering a voltage of an external power supply supplied from outside of the semiconductor device, comprising:

a circuit receiving the external power supply for generating said internal power supply in response to a control signal;

a potential adjustment circuit for a test operation, having fuse elements for outputting an adjustment signal;

a potential control circuit for the test operation receiving the adjustment signal, for controlling a potential of said control signal in response to the adjustment signal; and a power supply circuit generating a power supply voltage to the potential adjustment circuit, the power supply voltage having a lower potential than said voltage of the external power supply.

8. The internal step-down power supply circuit as set forth in claim 7, wherein said potential control circuit for the test operation has a resistor string for deciding the potential of said control signal.

9. The internal step-down power supply circuit as set forth in claim 8, wherein said potential adjustment circuit for the test operation includes a fuse circuit containing the fuse elements and a decoder circuit for decoding an output signal of the fuse circuit representing a state of said fuse elements in said fuse circuit, and a resistance value of said resistor string is selected in accordance with a decoding result of said decoder circuit.

10. An internal step-down power supply circuit for a semiconductor device for lowering a voltage of an external power supply supplied from outside of the semiconductor device, comprising:

a circuit receiving the external power supply for generating said internal power supply in response to a control signal;

a potential adjustment circuit for a test operation, having fuse elements for outputting an adjustment signal;

a potential control circuit for the test operation, receiving the adjustment signal, for controlling a potential of said control signal in response to the adjustment signal;

a power supply circuit generating a power supply voltage to the potential adjustment circuit, the power supply voltage having a potential lower than a voltage of said internal power supply.

11. The internal step-down power supply circuit as set forth in claim 10, wherein said potential control circuit for the test operation includes a resistor string for deciding the potential of said control signal.

12. The internal step-down power supply circuit as set forth in claim 11, wherein said potential adjustment circuit for the test operation includes a fuse circuit containing the fuse elements and a decoder circuit for decoding an output signal of the fuse circuit representing a state of said fuse elements in said fuse circuit, and a resistance value of said resistance string is selected in accordance with a decoding result of said decoder circuit.

13. An internal step-down power supply circuit, comprising:

an internal power supply voltage generation portion receiving an external power supply voltage, for generating an internal power supply voltage in response to a control voltage, the internal power supply voltage in a normal operation being lower than said external power supply voltage and the internal power supply voltage in a test operation being higher than the internal power supply voltage in the normal operation;

a potential adjustment circuit for the test operation, receiving the internal power supply voltage and including fuse elements, for generating an adjustment signal; and a potential control circuit for controlling said control voltage in response to the adjustment signal.

14. The internal step-down power supply circuit as set forth in claim 13, wherein said potential control circuit includes a resistor string for determining said control voltage.

15. The internal step-down power supply circuit as set forth in claim 14, wherein the potential adjustment circuit for the test operation includes a fuse circuit having the fuse element and a decoder circuit for decoding an output signal of the fuse circuit to generate the adjustment signal, and a terminal voltage of said resistor string is selected in response to the adjustment signal.

16. The internal step-down power supply circuit as set forth in claim 13, wherein the fuse elements are connected between a first terminal having the internal power supply voltage and a second terminal having a reference potential.

17. The internal step-down power supply circuit as set forth in claim 14, the potential control circuit further including:

a reference voltage generating circuit receiving the external power supply voltage, for generating a reference voltage; and a comparator comparing an output voltage from the resistor string with the reference voltage, for controlling the control voltage.

* * * * *